US008397370B2

(12) United States Patent
Rothkopf et al.

(10) Patent No.: US 8,397,370 B2
(45) Date of Patent: Mar. 19, 2013

(54) METHODS FOR DESIGNING AN ANTENNA USING AN OVERSIZED ANTENNA FLEX

(75) Inventors: Fletcher Rothkopf, Mountain View, CA (US); Brian Lynch, Portola Valley, CA (US); Wey-Jiun Lin, Los Altos Hills, CA (US); Kyle Yeates, Palo Alto, CA (US); Yi Jiang, Cupertino, CA (US)

(73) Assignee: Apple Inc., Cupertino, CA (US)

( * ) Notice: Subject to any disclaimer, the term of this patent is extended or adjusted under 35 U.S.C. 154(b) by 526 days.

(21) Appl. No.: 12/555,651

(22) Filed: Sep. 8, 2009

(65) Prior Publication Data

US 2011/0057842 A1 Mar. 10, 2011

(51) Int. Cl.
*H01P 11/00* (2006.01)

(52) U.S. Cl. ..... 29/600; 29/592.1; 343/700 MS

(58) Field of Classification Search ..... 29/600, 29/830–831, 832, 592.1; 343/700 MS, 868; 340/572.1–572.5
See application file for complete search history.

(56) References Cited

U.S. PATENT DOCUMENTS

| | | | | |
|---|---|---|---|---|
| 3,231,894 | A * | 1/1966 | Nagai | 343/806 |
| 6,011,699 | A * | 1/2000 | Murray et al. | 361/814 |
| 6,768,463 | B2 * | 7/2004 | Chen et al. | 343/700 MS |
| 6,801,170 | B2 * | 10/2004 | Forrester et al. | 343/702 |
| 7,080,787 | B2 * | 7/2006 | Wulff et al. | 235/462.45 |
| 7,486,243 | B2 * | 2/2009 | Wulff et al. | 343/702 |
| 7,911,397 | B2 * | 3/2011 | Degner et al. | 343/702 |
| 8,059,008 | B2 * | 11/2011 | Marincak | 340/657 |
| 8,169,373 | B2 * | 5/2012 | Schlub et al. | 343/702 |

* cited by examiner

*Primary Examiner* — Minh Trinh
(74) *Attorney, Agent, or Firm* — David C. Kellogg

(57) ABSTRACT

This is directed to an antenna for use in an electronic device. The antenna can be constructed from a flex and printed trace, such that the flex is originally defined to be as large or nearly as large as possible to fit within portion of the electronic device dedicated to the antenna. This can allow the antenna trace to vary as the antenna is tuned without requiring a new flex having a different shape. In addition, this can allow the antenna design to be decoupled from the mechanical considerations related to mounting the antenna within the electronic device.

11 Claims, 4 Drawing Sheets

METHODS FOR DESIGNING AN ANTENNA USING AN OVERSIZED ANTENNA FLEX

BACKGROUND OF THE INVENTION

This is directed to a flex used to form an antenna in a handheld electronic device.

A portable electronic device can include communications circuitry for connecting to a communications network and receiving information from one or more remote sources. The communications circuitry can include an antenna for receiving wireless signals (e.g., electromagnetic radiations of particular frequencies) associated with the communications circuitry. The antenna can be manufactured from any suitable material or combination of materials. For example, the antenna can be manufactured by placing conductive traces on piece of flex material that is folded in a particular configuration. To reduce the cost of constructing the antenna, the flex material can be shaped to substantially match the shape and position of the conductive traces.

During development, the antenna design can be tested and revised based on testing results. As the antenna design is revised, the shape, size and position of the traces on the flex material can change. If the re-drawn traces extend beyond an initial shape of the flex, a new flex may be required for antenna testing. To manufacture a new flex, a new tool may be required and constructed. The lead-time for the new tool, however, can be significant (e.g., two weeks).

SUMMARY OF THE INVENTION

This is directed to an antenna constructed from traces drawn on flex material. In particular, this is directed to defining a piece of flex material that is sized such that the single piece of flex material will be large enough for all likely trace configurations to be used to tried during antenna development.

Some electronic devices can include an antenna for receiving electromagnetic waves associated with a communications network. The antenna can be constructed using any suitable approach, including for example by defining conductive traces on a section of flex material (e.g., polyamide). During development, several antenna designs can be manufactured and tested. Each antenna design can include different configurations of traces on the flex material. In some cases, the particular configurations of traces can extend beyond an initially manufactured section of flex material.

When the revised trace configuration cannot fit on an initially manufactured flex, a new flex having different dimensions appropriate for the revised trace configuration must be manufactured. The tool for cutting the flex from sheets of polyamide, however, can take a significant lead-time to be prepared (e.g., two weeks). This lead-time can cause unwanted delays during development, which can cause the development deadlines to be missed and can delay the announcement or sale of a new electronic device.

To ensure that the antenna development does not cause unexpected delays, the initial flex material used for the antenna can be shaped such that the flex outline exceeds all expected trace patterns that could be tried during the antenna development. In particular, the flex shape can be selected to be as large as the space dedicated to the antenna in the device. In addition, this can have a secondary advantage of decoupling the antenna design from the mechanical assembly of the antenna flex in the device.

BRIEF DESCRIPTION OF THE DRAWINGS

The above and other features of the present invention, its nature and various advantages will be more apparent upon consideration of the following detailed description, taken in conjunction with the accompanying drawings in which.

DETAILED DESCRIPTION

An electronic device can include communications circuitry for connecting to a communications network. To receive wireless electromagnetic waves, the communications circuitry can include an antenna. The antenna can be constructed from several conductive traces applied in a particular pattern on a piece of flex mounted to the device. The flex can be of any suitable size, including for example a size generally matching the trace pattern, or substantially larger than the trace pattern (e.g., taking up as much room as possible within the device).

Figure 1:
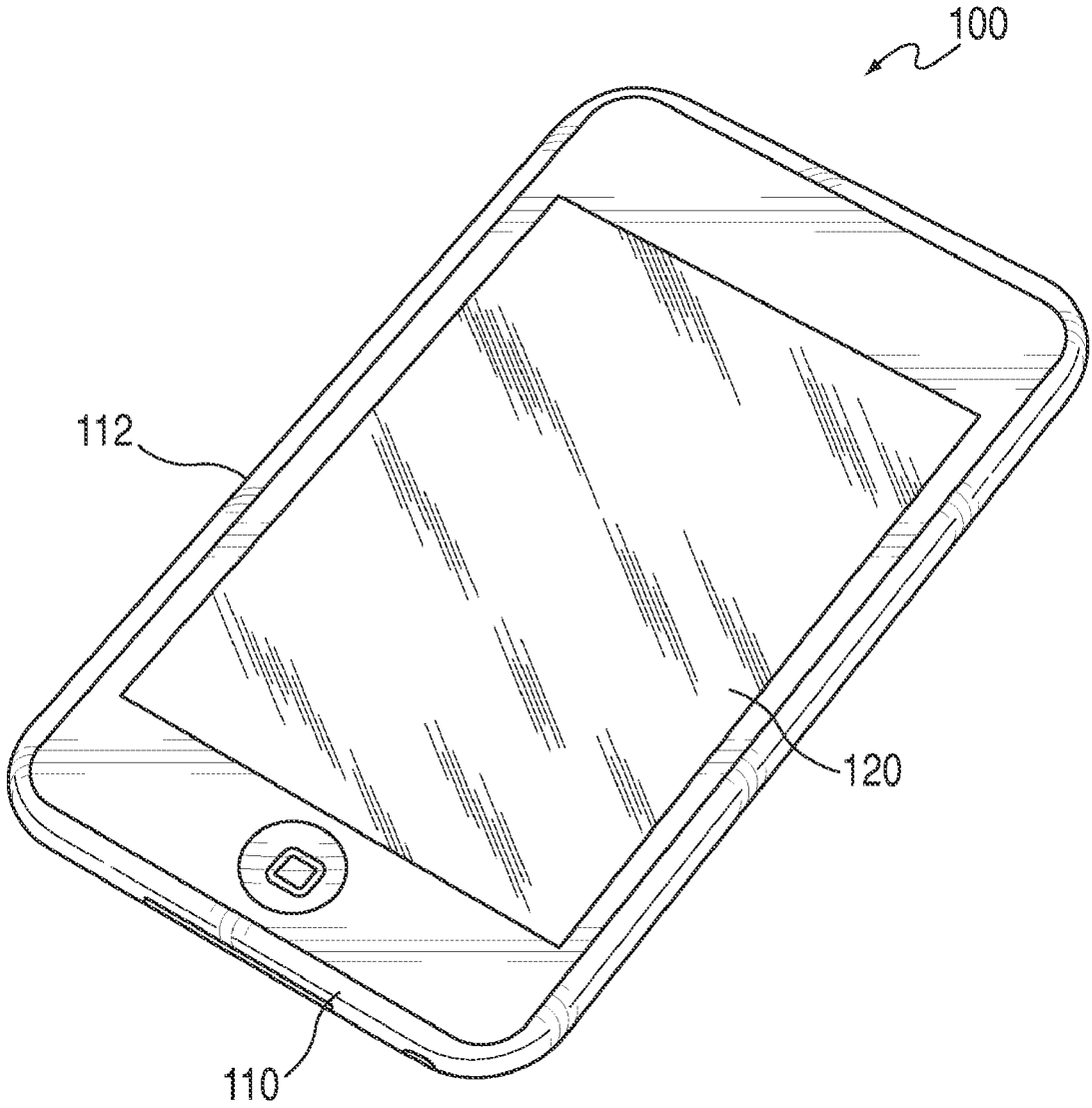
FIG. 1 is a schematic view of an illustrative electronic device in accordance with one embodiment of the invention.

FIG. 1 is a schematic view of an electronic device in accordance with one embodiment of the invention. Electronic device 100 can include housing 110, bezel 112, and window 120. Bezel 112 can be coupled to housing 110 in a manner to secure window 120 to the bezel. Housing 110 and bezel 112 can be constructed from any suitable material, including for example plastic, metal, or a composite material. Window 120 can be constructed from any suitable transparent or translucent material, including for example glass or plastic. Different electronic device components can be retained within electronic device 100 to provide different functionality to the user.

In one implementation, the electronic device can include an antenna for receiving electromagnetic waves associated with a communications network. The antenna can be constructed from any suitable combination of materials, including for example from conductive wire (e.g., copper traces) printed or embedded in a flex material. The flex material can be mounted within the electronic device to position the antenna in a particular desired configuration.

Figure 2B:
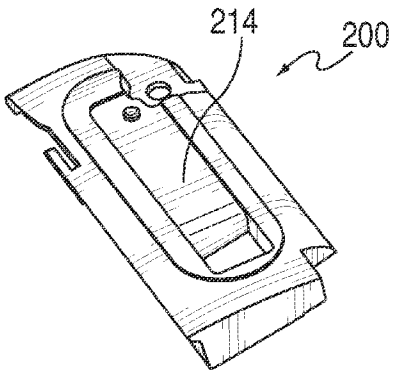
FIGS. 2A and 2B are schematic views of an illustrative antenna mount in accordance with one embodiment of the invention
Figure 3B:
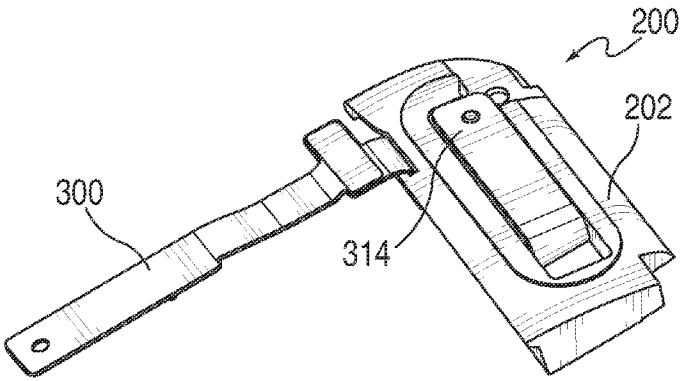
FIGS. 3A and 3B are schematic views of the antenna mount of FIGS. 2A and 2B in which an antenna flex is mounted in accordance with one embodiment of the invention.
Figure 2A:
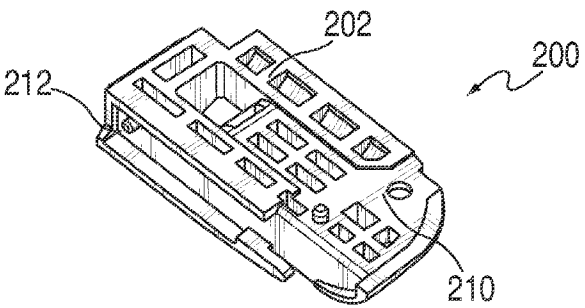
Figure 3A:
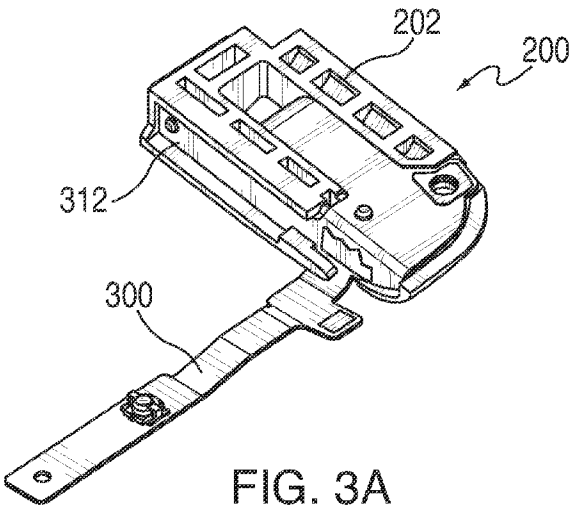

FIGS. 2A and 2B are schematic views of an illustrative antenna mount in accordance with one embodiment of the invention. Antenna mount 200 can be placed within an electronic device in the space of the device dedicated to the antenna. In some embodiments, antenna mount 200 can define the total available space for the antenna. Antenna mount 200 can include recessed channels or paths 210, 212 and 214 in body 202 for receiving portions of an antenna flex. Paths 210, 212 and 214 can be connected to allow a single flex to wrap around body 202 and provide effective signal reception in different orientations. The size and position of each of paths 210, 212 and 214 can be selected based on the antenna design (e.g., the size and shape of the antenna flex). FIGS. 3A and 3B are schematic views of the antenna mount of FIGS. 2A and 2B in which an antenna flex is mounted in accordance with one embodiment of the invention. Flex 300 can be positioned within paths 210, 212 and 214 such that individual tabs 312 and 314 of flex 300 wrap around body 202. Mount 200 can be constructed from any suitable material, including for example non-conductive material (e.g. plastic) for ensuring proper antenna operation.

During development, the particular configuration of the antenna can change as the antenna is tested. For example, the antenna can be tested for receiving signals from particular sources, at particular frequencies, and at particular signal strengths. The antenna configuration can then be tuned to optimize the antenna performance. In particular, the size or pattern of the traces on the flex can change. For example, the size of a trace loop can increase or decrease. As another example, the number, frequency, or amplitude of waves in a waveform antenna can change. As still another example, the position of a grounding element for the antenna can change. As the trace pattern changes, the size and shape of flex 300 can be adjusted to match the trace pattern. This in turn can reduce the total amount of flex used for the antenna, and ensure that flex 300 fits within a portion of mount 200.

Changing the antenna flex, however can be a time-intensive process. In particular, the tool used for cutting the antenna flex in the appropriate size can require a manufacturing lead-time prior to being available for further testing and tuning. In some cases, the lead-time can be two weeks, which can significantly impact a development schedule. In addition, each time the flex shape is changed, a new mount (e.g., mount 200) may be required to match the new flex shape. This can also impact the development schedule and delay the final design of the mount.

To eliminate the need to re-define the antenna flex each time the antenna traces are tuned, the antenna flex can initially be defined to be as large as possible. In particular, the antenna flex can be defined to be the largest flex that will fit in the space dedicated to the antenna (e.g., the largest flex for mount 200, FIG. 2). For example, the paths defined in the mount can be selected to be as long and wide as possible, and the flex can be cut in a manner as to fit within the defined paths. In this manner, the trace pattern will necessarily fit on the flex as it is tuned, since the trace pattern will not extend beyond the defined boundaries of the flex. This single flex can be used during development and production, thus ensuring that no time is lost due to the lead-time required for cutting a new flex.

This approach can provide a secondary benefit with respect to the development of the device assembly. Because the flex shape does not vary during development, only a single mount needs to be developed to support the flex. In this manner, the mechanical design of the antenna and antenna support can be decoupled from the design of the actual antenna itself, which may render the mechanical development of the electronic device more efficient.

Figure 4:
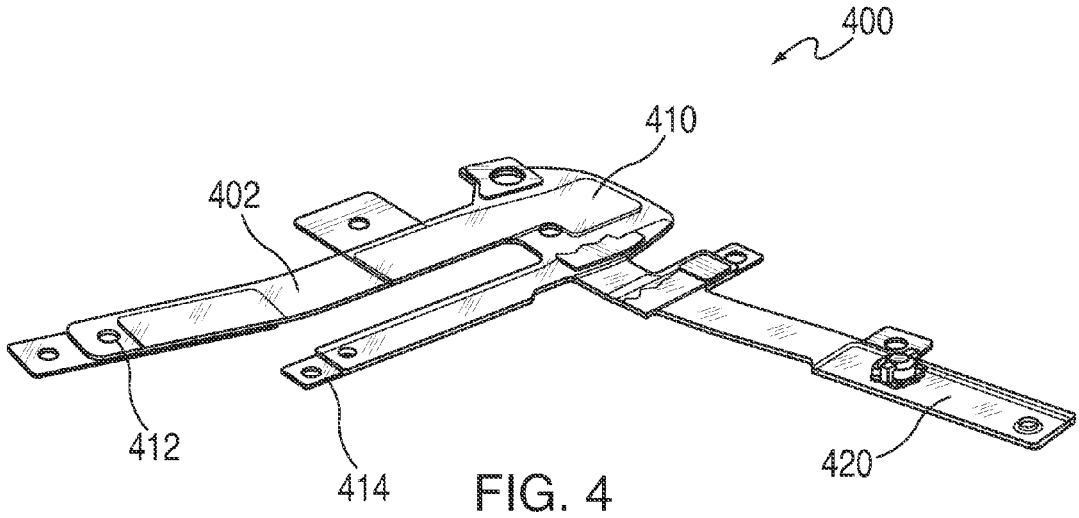
FIG. 4 is a schematic view of an illustrative antenna when flat in accordance with one embodiment of the invention.
Figure 5:
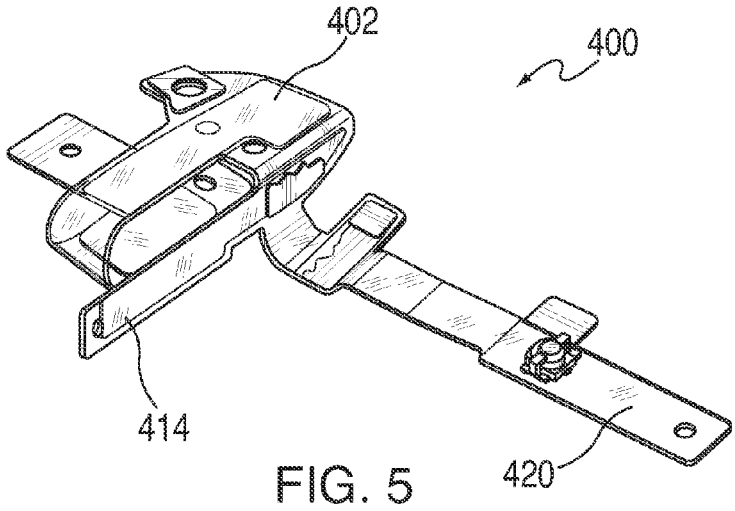
FIG. 5 is a schematic view of the illustrative antenna of FIG. 4 in which the flex is folded in accordance with one embodiment of the invention.

FIG. 4 is a schematic view of an illustrative antenna when flat in accordance with one embodiment of the invention. FIG. 5 is a schematic view of the illustrative antenna of FIG. 4 in which the flex is folded in accordance with one embodiment of the invention. Antenna 400 can be formed from a section of flex on which conductive traces are drawn. Flex 402 can be formed in any suitable shape, including for example a shape having base 410 from which tabs 412 and 414 extend, and connecting element 420 for coupling antenna 400 to a circuit board or to other components of the electronic device. Any other suitable shape can be selected for flex 402, including for example a shape selected based on an expected trace pattern or trace footprint. As another example, the shape can be selected based on the space available in the electronic device for the antenna (e.g., as determined from mount 200, FIG. 2) and the expected folded shape of the antenna when placed on the mount.

In some embodiments, the number, shape and size of tabs 412 and 414 can be larger than the tabs actually required for the conductive traces of the antenna. In some cases, the antenna may not even use one or more of the tabs. For example, tab 414 can include no conductive trace, and not be used for grounding or other antenna operations, although tab 414 may have initially been included to ground antenna 400 in a particular antenna implementation. The final validated antenna, however, may still include tab 414 as the antenna design that was validated included the tab.

Figure 6:
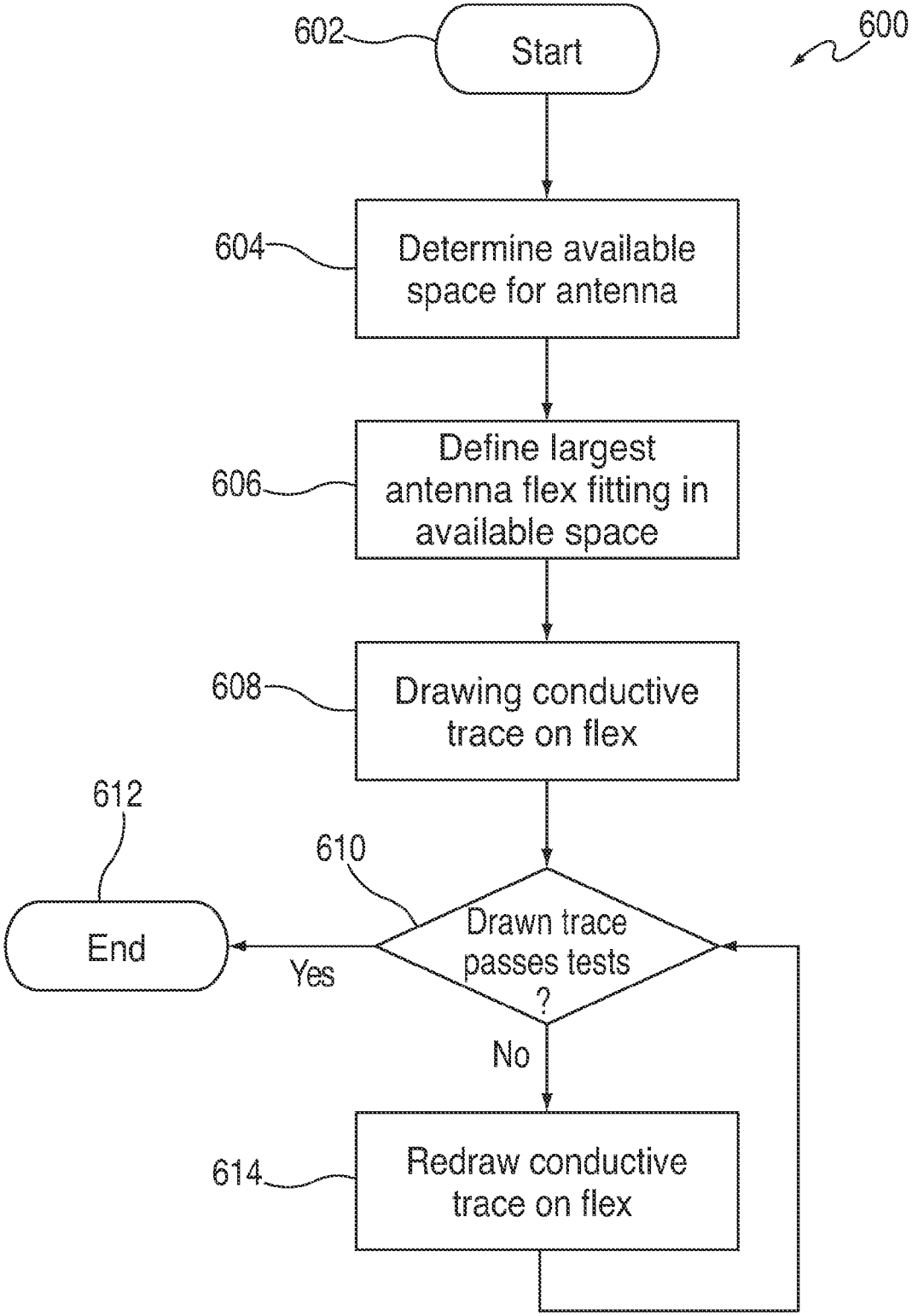
FIG. 6 is a flowchart of an illustrative process for designing an antenna in accordance with one embodiment of the invention.

FIG. 6 is a flowchart of an illustrative process for designing an antenna in accordance with one embodiment of the invention. Process 600 can begin at step 602. At step 604, the available space for an antenna in a device can be determined. For example, the amount of space dedicated to the antenna can be determined. At step 606, the largest antenna flex that could fit in the determined available space can be defined. For example, a flex having several tabs can be defined, where the number and size of each tab can be determined from the amount of available space in the device. In some embodiments, the shape of the flex can be determined from the space available in a mount used to support the flex within the device. The exact size of the flex can be selected to maximize the flex size, or can instead or in addition be selected based on manufacturing considerations, costs considerations, expected antenna trace patterns, or any other considerations. In some embodiments, the defined flex size may not be the largest available flex, but instead a large flex that can support a large variety of trace patterns, including some, most or all of the trace patterns expected to be used during development.

At step 608, conductive traces defining the antenna can be drawn on the flex. For example, copper traces can be deposited in a particular pattern on the flex. At step 610, testing can occur to determine whether the drawn traces and resulting antenna pass development validation tests. For example, testing can occur to measure the ability of the antenna to receive signals from different types of sources, at different frequencies, and at varying signal strength. If the antenna configuration passes testing, process 600 can end at step 612. If, at step 610, the antenna instead fails the tests, process 600 can move to step 614. At step 614, a different trace configuration or pattern can be drawn on the trace. Process 600 can then return to step 610 to test and validate the revised trace configuration.

The previously described embodiments are presented for purposes of illustration and not of limitation. It is understood that one or more features of an embodiment can be combined with one or more features of another embodiment to provide systems and/or methods without deviating from the spirit and scope of the invention. The present invention is limited only by the claims which follow.

What is claimed is:

1. A method for designing an antenna, comprising:

determining a space in an electronic device that is dedicated to the antenna;

defining a largest possible flex having the largest possible size and shape for use as part of the antenna that fits in the determined space;

cutting a flex that is substantially the size and shape of the defined flex;

drawing an antenna trace from a conductive material on the cut flex;

testing the drawn antenna trace;

determining that the drawn antenna trace is inadequate; and revising the antenna trace on a new flex having the same shape as the initial flex.

2. The method of claim 1, further comprising:

designing a mount to be placed in the determined space; and wherein defining the largest possible flex comprises defining the largest possible flex that can be coupled to the designed mount.

3. The method of claim 2, further comprising:

defining at least one path in the mount for receiving the flex.

4. The method of claim 1, further comprising:

drawing a plurality of different trace patterns on a respective plurality of new flexes, wherein each of the plurality of different trace patterns fits within the boundaries of the largest possible flex.

5. The method of claim 1, wherein: a portion of the flex is not used as part of the antenna.

6. The method of claim 1, wherein: cutting the flex further comprises cutting a flex that is the size and shape of the defined flex.

7. The method of claim 1, wherein revising the antenna trace further comprises changing the number of waves in a trace wave pattern.

8. The method of claim 1, wherein revising the antenna trace further comprises changing the length of a trace loop.

9. The method of claim 1, wherein revising the antenna trace further comprises changing at least one of the amplitude and the frequency of a wave in a trace wave pattern.

10. The method of claim 1, wherein drawing an antenna trace further comprises drawing at least two types of trace patterns.

11. The method of claim 10, wherein the at least two types of trace patterns comprise loops and waves.

* * * * *